US010438734B2

(12) United States Patent
Bel Fdhila et al.

(10) Patent No.: US 10,438,734 B2
(45) Date of Patent: Oct. 8, 2019

(54) COOLING OF A STATIC ELECTRIC INDUCTION SYSTEM

(71) Applicant: ABB Schweiz AG, Baden (CH)

(72) Inventors: Rebei Bel Fdhila, Västerås (SE); Tor Laneryd, Enköping (SE); Jurjen Kranenborg, WK Groningen (NL); Andreas Gustafsson, Ludvika (SE); Jan Hajek, Ludvika (SE)

(73) Assignee: ABB Schweiz AG, Baden (CH)

( * ) Notice: Subject to any disclaimer, the term of this patent is extended or adjusted under 35 U.S.C. 154(b) by 0 days.

(21) Appl. No.: 15/751,854

(22) PCT Filed: Jun. 22, 2016

(86) PCT No.: PCT/EP2016/064416
§ 371 (c)(1),
(2) Date: Feb. 10, 2018

(87) PCT Pub. No.: WO2017/029002
PCT Pub. Date: Feb. 23, 2017

(65) Prior Publication Data

US 2018/0240587 A1 Aug. 23, 2018

(30) Foreign Application Priority Data

Aug. 14, 2015 (EP) ..... 15181124

(51) Int. Cl.
*H01F 27/10* (2006.01)

(52) U.S. Cl.
CPC ..... *H01F 27/10* (2013.01)

(58) Field of Classification Search
CPC ..... H01F 27/10; H01F 27/105; H01F 27/12; H01F 27/125; H01F 27/14; H01F 27/16;
(Continued)

(56) References Cited

U.S. PATENT DOCUMENTS 2,479,373 A 8/1949 Knotts et al.
2,917,701 A 12/1959 Salton
(Continued)

FOREIGN PATENT DOCUMENTS

CN 2260374 Y 8/1997
CN 2632856 Y 8/2004
(Continued)

OTHER PUBLICATIONS

European Search Report Patent No. EP15181124 Completed Date: Feb. 19, 2016; dated Mar. 4, 2016 8 pages.
(Continued)

*Primary Examiner* — Mang Tin Bik Lian
(74) *Attorney, Agent, or Firm* — Whitmyer IP Group LLC

(57) ABSTRACT

A static electric induction system is disclosed. The system includes a heat generating component, cooling fluid, a cooling duct along the heat generating component and a pumping system configured for driving the cooling fluid through the cooling duct, wherein the pumping system is configured for applying a varying flow rate over time of the cooling fluid in the cooling duct along a predetermined flow rate curve which is a function of time.

19 Claims, 4 Drawing Sheets

(58) Field of Classification Search
CPC ..... H01F 27/18; H01F 27/08; H01F 27/2876; H01F 27/321; H01F 27/322
USPC ..... 336/57, 58, 90, 62, 64
See application file for complete search history.

(56) References Cited

U.S. PATENT DOCUMENTS

| | | | | |
|---|---|---|---|---|
| 4,424,502 | A * | 1/1984 | Kullinger | H01F 27/12 165/104.31 |
| 8,081,054 | B2 | 12/2011 | Guentert, III et al. | |
| 2010/0315188 | A1* | 12/2010 | Hoffman | H01F 27/402 336/57 |
| 2011/0140820 | A1* | 6/2011 | Guentert, III | H01F 27/12 336/58 |
| 2012/0044032 | A1* | 2/2012 | Sathe | H01F 27/18 336/62 |
| 2014/0132379 | A1* | 5/2014 | Vafakhah | H01F 37/00 336/57 |
| 2015/0219104 | A1 | 8/2015 | Lee et al. | |

FOREIGN PATENT DOCUMENTS

| | | | |
|---|---|---|---|
| CN | 102349121 | A | 2/2012 |
| CN | 202768316 | U | 3/2013 |
| CN | 103603814 | A | 2/2014 |
| CN | 103608557 | A | 2/2014 |
| EP | 3131104 | A1 | 2/2017 |
| GB | 887383 | A | 1/1962 |
| JP | S618909 | A | 1/1986 |
| JP | H06231972 | A | 8/1994 |
| JP | H0955322 | A | 2/1997 |
| JP | 2006032651 | A | 2/2006 |

OTHER PUBLICATIONS

International Search Report & Written Opinion of the International Searching Authority Application No. PCT/EP2016/064416 Completed Date: Sep. 7, 2016; dated Sep. 20, 2016 12 pages.
Chinese Office Action & Translation Application No. 2016800472137 dated Nov. 26, 2018 13 pages.
Peiji Sun; "Metallurgical and chemical processes and equipment" and Translation, Metallurgical Industry Press, Dec. 1980 pp. 89-92.
The People's Republic of China Office Action & Translation Application No. 2016800472137 dated Apr. 17, 2019 6 pages.

* cited by examiner

COOLING OF A STATIC ELECTRIC INDUCTION SYSTEM

TECHNICAL FIELD

The present disclosure relates to a static electric induction system comprising a heat generating component and a cooling fluid.

BACKGROUND

Today the forced cooling of a static electric induction system such as a power transformer or reactor is usually performed at a steady state with a constant cooling fluid flow rate.

There are three main modes of heat transfer involved in the cooling of the induction system, e.g. of the conductor windings thereof. Conduction in the conductor, diffusion from the surface of the conductor to the bulk of the cooling fluid and convection by the fluid stream. During the conduction phase there is a time lag to transfer the heat from, e.g., the middle of the conductor to its surface. The diffusion is very slow for laminar flows but gets substantially faster when the flow structure becomes turbulent or contains inherent instabilities. The convection time scale corresponds to the ability of the fluid and flow to carry the heat from a point situated in the bulk to a point downstream. In general, the conduction time constant is by far larger than the time constants needed by convection and turbulence or instabilities induced diffusion.

It is known to temporarily increase the flow rate of the cooling fluid in response to a temperature increase in the fluid. For instance, JP 2006/032651 discloses the use of an insulating medium circulation flow rate increasing means which is able to temporarily increase the flow rate of the insulating/cooling medium above a steady-state flow rate upon detection of a temperature increase in the insulating medium in an electrical apparatus with an iron core and winding.

However, to merely measure a temperature of the insulating medium is not sufficient to determine the occurrence of any hotspots within such an electrical apparatus. The outlet temperature of the insulating medium only gives a general measure of the amount of heat exchanged, not a measurement of how efficient or uniform the heat exchange is.

SUMMARY

It is an objective of the present invention to improve the cooling of a static electric induction system.

Typically, the heat flows slowly in the conductor winding of a static electric induction system and is often very quickly transported by the cooling fluid. This implies that the heat may not have to be convected so quickly since it is generated in a slower process. Also, it has been noted that hotspots may be formed, e.g. due to static swirls or locally stagnant fluid, also at increased flow rate of the cooling fluid. Thus, to merely increase the flow rate may not eliminate hotspots or at all (or only to a limited degree) improve the cooling of the static electric induction system.

In accordance with the present invention, the cooling is improved by varying the cooling fluid flow rate over time along a predetermined flow rate curve which is a function of time. That the curve is predetermined implies that it is not dependent on real-time measurements e.g. of fluid temperature. Rather, the flow rate curve may be a function of only time or a function of both time and temperature e.g. measured (possibly in real-time) at one or several places in the static electric induction system. That the curve is predetermined may not preclude that a temperature measurement may also be allowed to affect the flow rate. For instance, a control unit of the static electric induction system may be pre-programmed with a plurality of predetermined flow rate curves wherein the choice of which one to use may be based on e.g. a temperature measurement or other measurement.

According to an aspect of the present invention, there is provided a static electric induction system. The system comprises a heat generating component, cooling fluid, a cooling duct along the heat generating component, and a pumping system configured for driving the cooling fluid through the cooling duct, wherein the pumping system is configured for applying a varying flow rate over time of the cooling fluid in the cooling duct along a predetermined flow rate curve which is a function of time.

According to another aspect of the present invention, there is provided a method of reducing hot spots in a static electric induction system. The method comprises cooling a heat generating component of the static electric induction system by means of a flow of cooling fluid through a cooling duct along the heat generating component. The method also comprises applying a varying flow rate over time of the flow of cooling fluid in the cooling duct along a predetermined flow rate curve, which is a function of time, by means of a pumping system of the static electric induction system.

It has been realised that by varying the flow rate, the cooling fluid may choose slightly different paths within the cooling duct, and positions of stagnant swirls or stagnant fluid or the like may move depending on the flow rate, thereby reducing the build-up of hotspots.

Thus, embodiments of the present invention relate to the prevention of hotspots to be formed in a static electric induction system, e.g. a transformer. To achieve more uniform cooling in the induction system, the flow rate of the cooling fluid is varied over time in accordance with a predetermined flow rate curve. The flow rate may or may not be varied regardless of any real-time measurements of e.g. temperature (since such measurements may not detect hotspots, unless the measurement is made precisely at such a hotspot).

It is to be noted that any feature of any of the aspects may be applied to any other aspect, wherever appropriate. Likewise, any advantage of any of the aspects may apply to any of the other aspects. Other objectives, features and advantages of the enclosed embodiments will be apparent from the following detailed disclosure, from the attached dependent claims as well as from the drawings.

Generally, all terms used in the claims are to be interpreted according to their ordinary meaning in the technical field, unless explicitly defined otherwise herein. All references to "a/an/the element, apparatus, component, means, step, etc." are to be interpreted openly as referring to at least one instance of the element, apparatus, component, means, step, etc., unless explicitly stated otherwise. The steps of any method disclosed herein do not have to be performed in the exact order disclosed, unless explicitly stated. The use of "first", "second" etc. for different features/components of the present disclosure are only intended to distinguish the features/components from other similar features/components and not to impart any order or hierarchy to the features/components.

BRIEF DESCRIPTION OF THE DRAWINGS

Embodiments will be described, by way of example, with reference to the accompanying drawings, in which.

DETAILED DESCRIPTION

Embodiments will now be described more fully hereinafter with reference to the accompanying drawings, in which certain embodiments are shown. However, other embodiments in many different forms are possible within the scope of the present disclosure. Rather, the following embodiments are provided by way of example so that this disclosure will be thorough and complete, and will fully convey the scope of the disclosure to those skilled in the art. Like numbers refer to like elements throughout the description.

Figure 1:
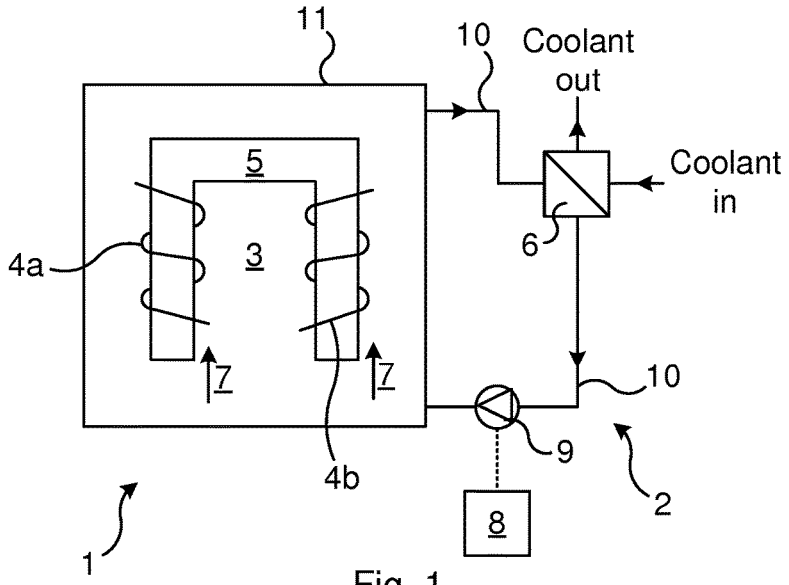
FIG. 1 is a schematic block diagram of an embodiment of a static electric induction system in accordance with the present invention.

FIG. 1 schematically illustrates an embodiment of a static electric induction system 1, here in the form of a power transformer with a transformer tank 11 which is filled with a cooling fluid 3, e.g. a mineral oil, an ester liquid or other electrically insulating liquid, or an electrically insulating gas. A transformer is used as an example, but the static electric induction system 1 of the present invention may alternatively be e.g. a reactor. The transformer in FIG. 1 is a single-phase transformer, but the discussion is in applicable parts relevant for any type of transformer or other static electric induction system 1 e.g. a three-phase transformer such as with a three or five legged core. It is noted that the figure is only schematic and provided to illustrate some basic parts of the static electric induction system.

Two neighbouring windings 4 (a & b) are shown, each comprising a coil of an electrical conductor around a core 5, e.g. a metal core. This is thus one example set-up of a transformer, but any other transformer set-up can alternatively be used with the present invention, as is appreciated by a person skilled in the art.

As discussed above, the static electric induction system 1 is fluid-filled with a cooling fluid 3 for improved heat transport away from heat generating components of the static electric induction system, such as the winding(s) 4 and core(s) 5 thereof. The fluid 3 may e.g. be mineral oil, silicon oil, synthetic ester or natural ester, or a gas (e.g. in a dry transformer). For high temperature applications, it may be convenient to use an ester oil, e.g. a natural or synthetic ester oil.

Further, the conductors of the windings 4 are insulated from each other and from other parts of the transformer 1 by means of the cooling fluid. Also solid insulators 31 (see FIG. 3) may be used to structurally keep the conductors and other parts of the static electric induction system 1 immobile in their intended positions. Such solid phase insulators are typically made of cellulose based pressboard or Nomex™ impregnated by the cooling fluid 3, but any other solid insulating material may be used. The insulators may e.g. be in the form of spacers separating turns or discs of a winding 4 from each other, axial sticks e.g. separating the conductor winding 4 from its core 5, from the tank 11 or from another winding 4, winding tables separating the windings from other parts of the static electric induction system 1 e.g. forming a support or table on which the windings, cores, yokes etc. rest, as well as cylinders positioned around a winding 4, between the a winding 4 and its core 5, or between different windings 4 or different conductor layers of a winding 4.

One or more cooling ducts 7 are present in the static electric induction system 1, as schematically indicated by the upward pointing arrows in FIG. 1 but further described with reference to other figures herein. A cooling duct 7 may e.g. be formed along a winding 4 (generally in its longitudinal direction) between an outer solid insulation cylinder positioned outside of the winding 4, and an inner solid insulation cylinder positioned inside the said winding, between the winding and the core 5 (i.e. the inner cylinder would be around the core, the winding would be around the inner cylinder, and the outer cylinder would be around the winding). However, this is merely an example and any other form of cooling duct 7 along a heat generating component such as a winding 4 and/or core 5 may also be envisioned. Cooling fluid 3 may flow (be driven by the pumping system 2) in any direction through a cooling duct 7, but it may be convenient to drive the cooling fluid in a generally upward direction since the pumping system will then cooperate with the passive heat convection of the fluid whereby warmer fluid has a lower density and thus rises.

The static electric induction system 1 also comprises a pumping system 2 configured for driving the cooling fluid through the cooling duct(s) 7. In the example of FIG. 1, the pumping system 2 comprises piping to form a cooling loop 10 for circulating the cooling fluid 3. Alternatively, the cooling fluid may be pumped from a cooling fluid source without being circulated and reused. The pumping system typically comprises a pump 9, which may be controlled by a control unit 8. The control unit 8 may control the pump 9 and thus the flow rate of the fluid 3 through the cooling duct 7. Alternatively, the flow rate of the fluid 3 through the cooling duct 7 may be controlled by means of a valve 41 (see FIG. 4). The control unit 8 may be pre-programmed with the predetermined flow rate curve in accordance with the present invention. In some embodiments, the control unit 8, e.g. with input from fibre optic sensors in the winding 4, may be configured for altering the mass flow rate along the predetermined flow rate curve depending on a current temperature distribution of the static electric induction system. For instance, the predetermined flow rate curve may be shifted (e.g. parallel displaced) towards a higher or lower flow rate depending on a temperature measurement, or one predetermined flow rate curve may be chosen (e.g. by the control unit 8) from among a plurality of predetermined flow rate curves.

In some embodiments, especially if a cooling loop 10 is used, the pumping system may comprise a heat exchanger 6 in which cooling fluid from inside of the tank 11 is cooled, e.g. by means of a (for instance counter current) flow of conventional coolant such as water or air.

The pumping system is configured for applying a varying flow rate of the cooling fluid in the cooling duct along a predetermined flow rate curve. The cooling may be intermittent, the flow rate oscillating between fast and slow modes. This can be performed by providing a variable flow rate of the cooling fluid by means of the pumping system. At low flow rates, the focus may mainly be on the transfer of the heat from the conductor to the fluid, i.e. it is as if the fluid 3 waits for the heat to come in. This organizes the transport of the heat in batches, filled during the low flow rate and evacuated during the high flow rate. The low and high flow rate levels and the corresponding time scales may be chosen by use of an appropriate optimization technique.

In some embodiments, layer windings with baffles 61 (see FIG. 6) may be used. Cooling fluid flow in a typical winding 4 may be laminar, which implies less efficient heat transfer. By introducing baffles in combination with a varying flow rate, the heat transfer coefficient may be improved to the level of turbulent heat transfer.

In some embodiments, the typical cooling fluid flow distribution through alternative flow paths in a cooling duct 7 may differ depending on the mass flow rate because the balance of pressure drop and buoyancy in the system will vary. A first example concerns windings 4 without oil guides. In this type of winding, the location of a hotspot may depend on the mass flow rate. By varying the mass flow rate, the location of the hotspot may be shifted, reducing time-averaged temperatures of said hotspot and thereby reducing ageing and increasing the lifetime of the static electric induction system 1. A second example concerns windings with oil guides, e.g. blocking some flow paths in a duct 7. By varying the mass flow rate, the location of the hotspot may be shifted, reducing time-averaged temperatures of said hotspot.

Figure 2:
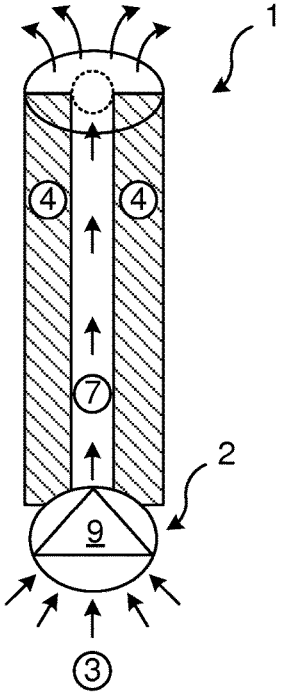
FIG. 2 is a schematic diagram, in longitudinal section, of an embodiment of a conductor winding with a cooling duct of a static electric induction system in accordance with the present invention.

FIG. 2 illustrates an embodiment of a static electric induction system 1 in which a cooling duct 7 is formed through a heat generating component, e.g. a conductor winding 4. A pump 9 of the pumping system 2 drives cooling fluid 3 through the cooling duct. In the embodiment of FIG. 2, the pump 9 is arranged to pump the fluid 3 directly into the cooling duct 7, and the cooling fluid may be an ambient gas such as air, whereby the use of a tank 11 is optional and the fluid need not be recycled.

Figure 3:
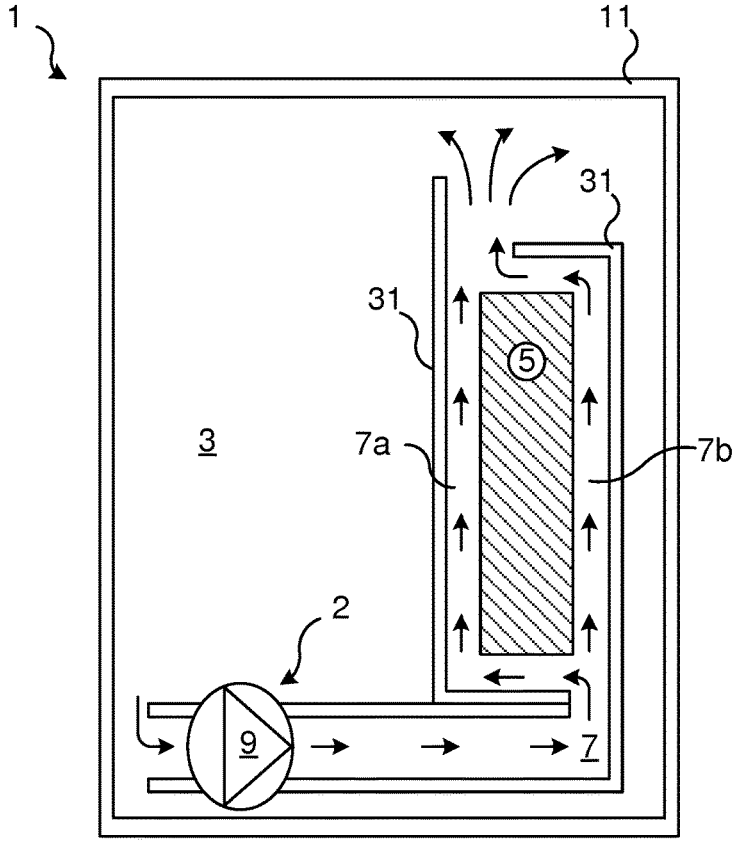
FIG. 3 is a schematic diagram of another embodiment of another static electric induction system in accordance with the present invention.

FIG. 3 illustrates another embodiment of a static electric induction system 1 in which a cooling duct 7 is formed comprising parallel flow paths 7*a* and 7*b* on either side of a heat generating component, e.g. a core 5. That the flow paths are parallel is herein not intended to imply that they are necessarily geometrically parallel, but rather that they are connected in parallel to each other as opposed to in series with each other. The cooling duct, comprising the plurality of flow paths 7*a* and 7*b*, is formed between the heat generating component and a solid barrier 31, typically of a solid insulation material. In this embodiment, a tank 11 is used, with the pumping system 2 comprising the pump 9 positioned inside the tank 11, allowing the cooling fluid 3 to be circulated in a closed system within the tank 11. However, this does not preclude that inlet(s) and outlet(s) of the tank 11 for the fluid 3 through a wall of the tank 11 may be present.

Figure 4:
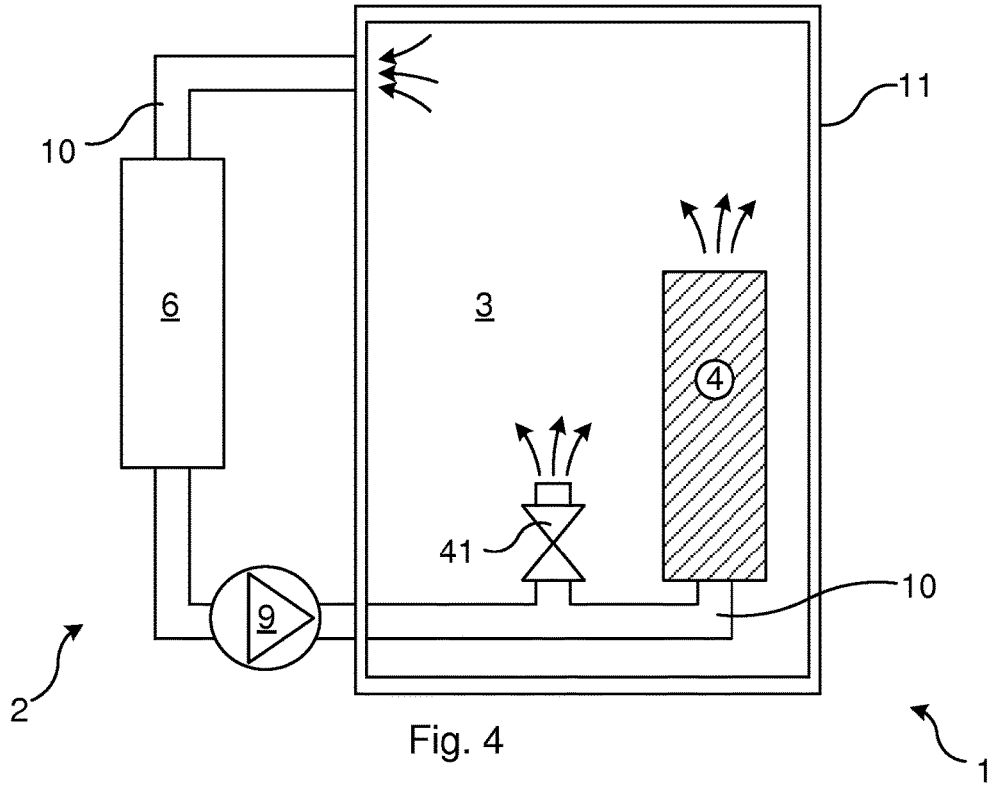
FIG. 4 is a schematic diagram of another embodiment of a static electric induction system in accordance with the present invention.

FIG. 4 illustrates another embodiment of a static electric induction system 1 in which piping forming a cooling loop 10 for circulating the cooling fluid 3 within the static electric induction system is used. The cooling loop 10 of the pumping system 2 comprises the pump 9 as well as a heat exchanger 6, and extends outside of the tank 11, sucking in cooling fluid into an outlet of the tank at the top of said tank and driving cooling fluid into a cooling duct (not shown) through a heat generating component 4. In this embodiment, the piping of the cooling loop 10 comprises a valve 41 inside the tank 11. The valve 41 is arranged for regulating how much of the cooling fluid 3 which passes through the heat exchanger and the pump is driven into cooling duct along the heat generating component 4. In a closed state of the valve 41, all the cooling fluid from the pump may be introduced into the cooling duct, while the more open the valve is, the lower ratio of the cooling fluid from the pump is introduced into the cooling duct and the higher ratio of the cooling fluid from the pump is introduced outside of the cooling duct, e.g. into a bulk of the cooling fluid or into another cooling duct 7 (not shown) in the tank 11, bypassing the cooling duct 7. It may be advantageous to maintain a substantially constant flow rate of the cooling fluid 3 through the heat exchanger 6 and/or the pump 9 since the heat exchanger 6 and/or the pump 9 may be optimised for a certain flow rate or flow rate range. By means of the valve 41, the varying flow rate in the cooling duct may thus be achieved by controlling the valve 41 instead of (or in addition to) the pump 9. The valve 41 may be controlled by the control unit 8, which may or may not also control the pump speed of the pump 9. Thus, in some embodiments, the cooling fluid 3 is circulated in the static electric induction system 1 via a cooling loop 10 comprising a heat exchanger 6, wherein the flow rate of the cooling fluid through the heat exchanger is substantially constant.

Figure 5:
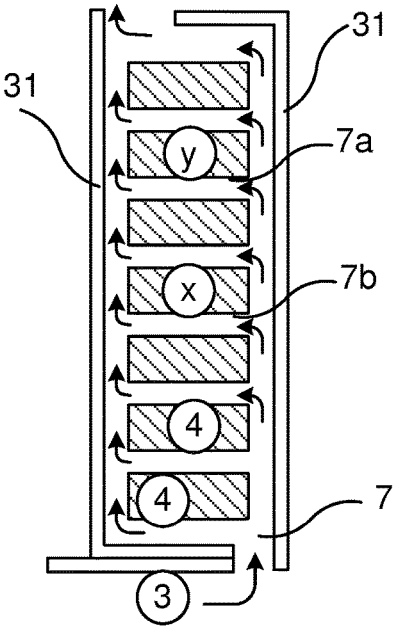
FIG. 5 is a schematic diagram of an embodiment of a cooling duct having a plurality of different parallel flow paths along an embodiment of a conductor winding of a static electric induction system in accordance with the present invention.

FIG. 5 illustrates an embodiment of a cooling duct 7 along a part of a heat generating component in the form of a conductor winding 4, where a plurality of turns of the winding 4 are separated (e.g. by spacers) in a vertical direction to form a plurality of parallel horizontal flow paths 7*a* and 7*b* (of which only two are provided with reference signs in the figure) of the cooling duct 7. Thus, the cooling fluid 3 is driven through the cooling duct 7, generally vertically upward but via any of the plurality of generally horizontal flow paths 7*a* and 7*b* between the winding turns. Typically, the ratio of the mass flow of the cooling fluid 3 in the cooling duct 7 which passes through a certain flow path 7*a* or 7*b* varies depending on the total mass flow rate through the cooling duct. Thus, for example, at a first flow rate through the cooling duct, a higher ratio of the mass flow may pass through the flow path 7*a* than through the flow path 7*b*, leading to the build-up of a hotspot x at the flow path 7*b*, while at a second flow rate through the cooling duct, a higher ratio of the mass flow may pass through the flow path 7*b* than through the flow path 7*a*, leading instead to the build-up of a hotspot y at the flow path 7*a*. By varying the flow rate of the cooling fluid 3 in accordance with the present invention, both hotspots x and y may thus be reduced.

Figure 6:
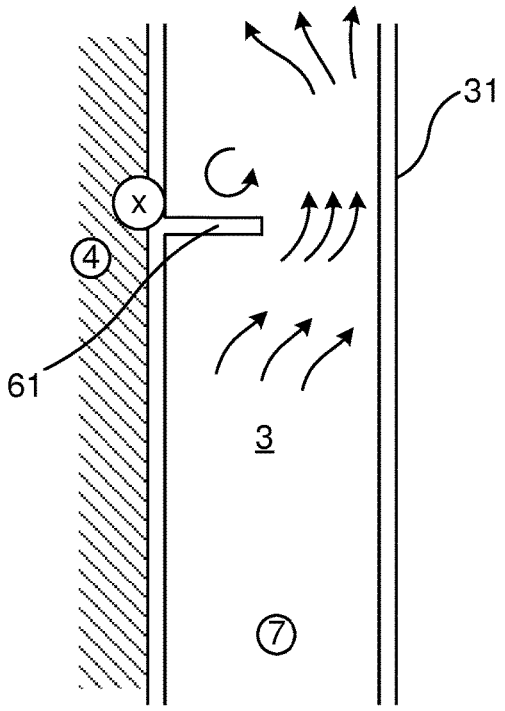
FIG. 6 is a schematic diagram of another embodiment of a cooling duct, having an obstacle for the cooling fluid, in the form of a baffle, of a static electric induction system in accordance with the present invention.

FIG. 6 illustrates a flow of cooling fluid 3 in a cooling duct 7 along a heat generating component, e.g. a conductor winding 4. As mentioned above, the cooling duct 7 may comprise obstacles 61 for the cooling fluid, e.g. fins, baffles and/or flow guides, e.g. to guide the cooling fluid into certain flow paths 7*a* or 7*b* or to improve mixing and turbulence of the cooling fluid. However, such an obstacle may also introduce static swirls which may lead to the build-up of hotspots. In the embodiment of the figure, a cooling fin 61, acting as a surface extension, is also an obstacle that creates a region of recirculation at a first flow rate, e.g. a high mass flow rate, generating a hot spot x above (downstream of) the cooling fin 61. By varying the flow rate, e.g. applying a lower flow rate, the swirl, and thus the hotspot, may be moved or even eliminated.

Figure 7:
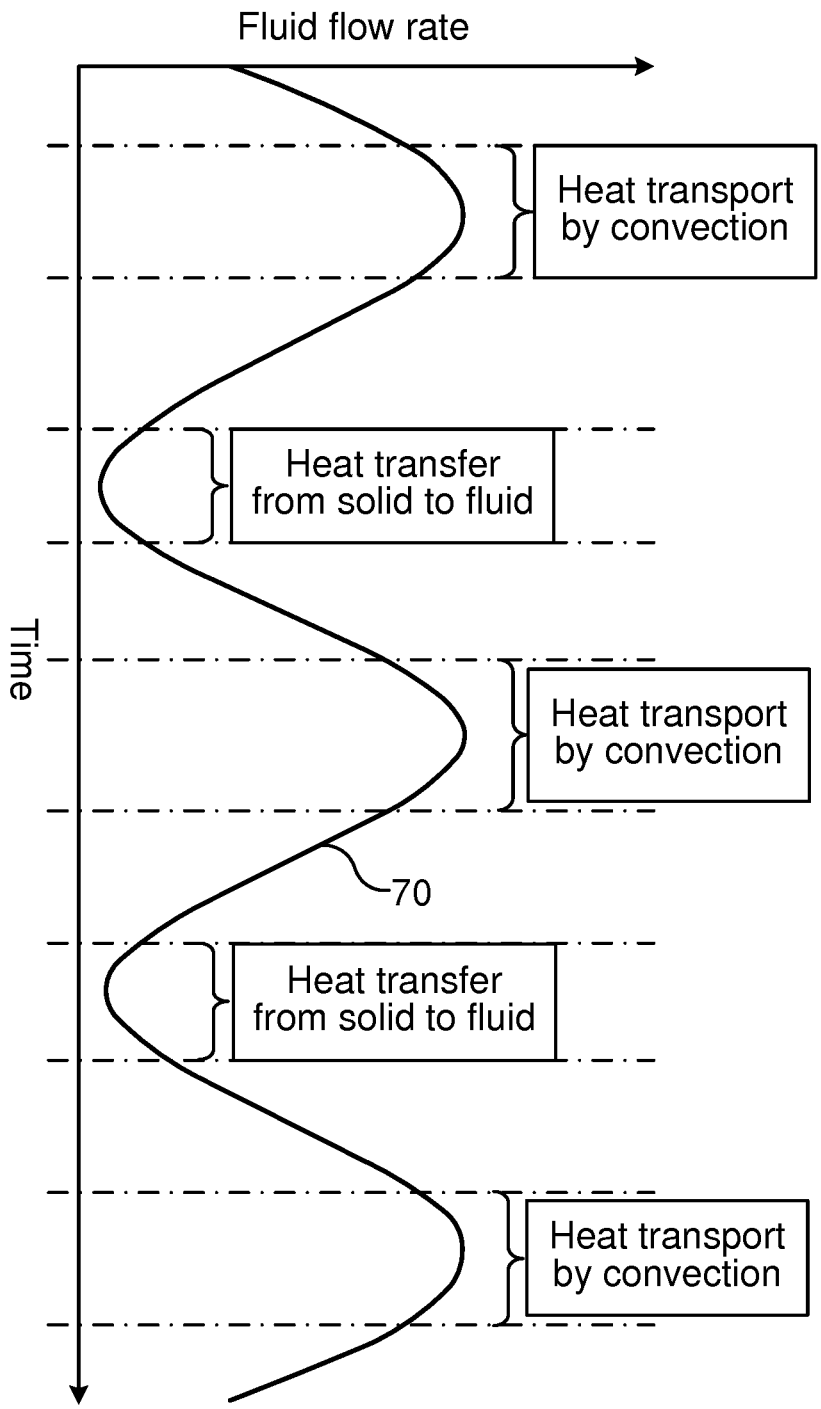
FIG. 7 is a schematic graph of an embodiment of a predetermined flow rate curve in accordance with the present invention.

FIG. 7 is an example of a predetermined flow rate curve of the present invention. As discussed herein, a varying flow rate reduces (the build-up of) hotspots in the static electric induction system, without the need to try to find and measure the temperature of such hotspots. Also, as marked in the figure, at a higher flow rate, heat transport in the static electric induction system is mainly done by convection (i.e. by the fluid 3 transporting the heat away from the heat generating component 4 and/or 5, while at a lower flow rate, heat transport may be mainly by diffusion from the solid heat generating component to the fluid 3. Thus, by means of the varying flow rate of the present invention, energy consumption for the cooling of the static electric induction system may be reduced by not constantly using an unnecessarily high flow rate.

The flow rate curve may have any suitable form, but it may e.g. oscillate (conveniently periodically) between a predetermined maximum flow rate and a predetermined minimum flow rate. For instance, as in FIG. 7, the oscillation is periodic, e.g. sinusoidal. In some embodiments, the periodicity is more than 1 second such as more than 10 seconds or more than 1 minute, and is thus longer than the frequency of the pump 9 (i.e. the flow rate variation is beyond any flow rate fluctuations introduced by the regular operation of the pump). The periodicity may be less than a day such as less than 1 hour or less than 20 minutes, to stop build-up of hotspots. In some embodiments, the flow rate through the cooling duct 7 is varying with a periodicity which is less than the time required for the heat generating component 4 or 5 to reach thermal steady-state, e.g. less than a thermal time constant of the heat generating component. When starting up a static electric induction system, it may take about a day for the components (both winding 4 and core 5) to reach a steady-state, while for the winding only it may take about an hour. The time constant may be the time it takes for the heat generating component to reach about 65% of the steady-state temperature, which for the winding 4 may take about 15 minutes.

Figure 8:
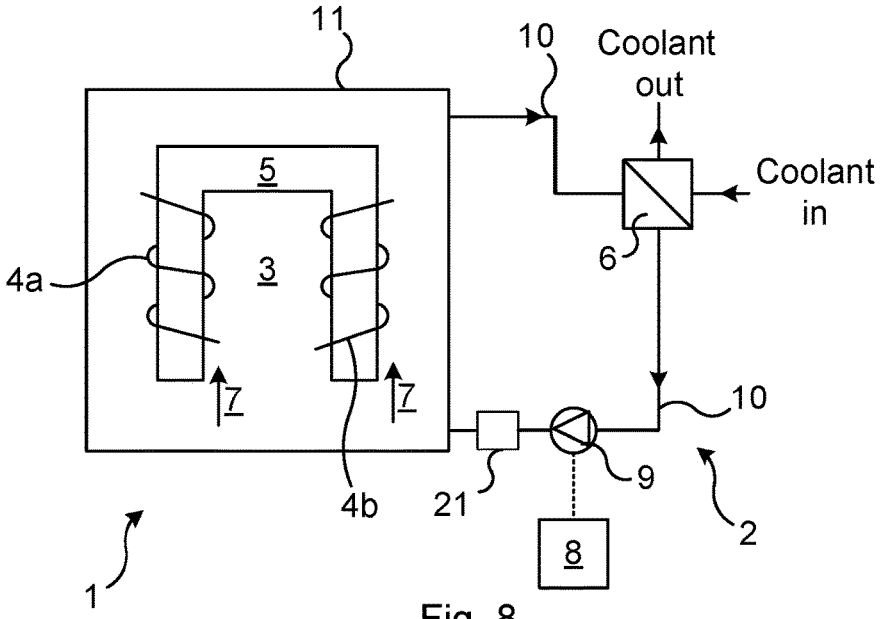
FIG. 8 is a schematic block diagram of an embodiment of a static electric induction system in accordance with the present invention.

Other components than those discussed herein in relation to the figures may also be included in the static electric induction system 1. For instance, the cooling loop 10 may comprise a pressure chamber 21 for distributing the cooling fluid to one or several cooling duct(s) 7, as shown in FIG. 8. Such a pressure chamber which is positioned upstream of a cooling duct is disclosed in e.g. U.S. Pat. No. 4,424,502, while US 2014/0327506 discloses one that is positioned downstream of a cooling duct.

The present disclosure has mainly been described above with reference to a few embodiments. However, as is readily appreciated by a person skilled in the art, other embodiments than the ones disclosed above are equally possible within the scope of the present disclosure, as defined by the appended claims.

The invention claimed is:

1. A static electric induction system comprising:

a heat generating component;

cooling fluid;

a cooling duct along the heat generating component; and a pumping system configured for driving the cooling fluid through the cooling duct;

wherein the pumping systems applies a varying flow rate over time of the cooling fluid in the cooling duct along a predetermined flow rate curve, which is a function of time and is not required to be dependent on real-time measurements;

wherein the flow rate cure oscillates between a predetermined maximum flow rate and a predetermined minimum flow rate.

2. The static electric induction system according to claim 1, further including:

a cooling loop for circulating the cooling fluid within the static electric induction system.

3. The static electric induction system according to claim 2, wherein the cooling loop includes a heat exchanger for cooling the cooling fluid.

4. The static electric induction system according to claim 2, wherein the cooling loop includes a pressure chamber for distributing the cooling fluid to the cooling duct.

5. The static electric induction system according to claim 1, wherein the cooling duct includes a plurality of flow paths connected in parallel with each other.

6. The static electric induction system according to claim 1, wherein the cooling duct includes obstacles for the cooling fluid.

7. The static electric induction system according to claim 6, wherein the obstacles are fins, baffles, and/or flow guides.

8. The static electric induction system according to claim 1, wherein the oscillation is periodic with a periodicity between 1 second and 1 day.

9. The static electric induction system according to claim 8, wherein the oscillation is sinusoidal.

10. The static electric induction system according to claim 8, wherein the oscillation is periodic with a periodicity between 1 and 20 minutes.

11. The static electric induction system according to claim 1, wherein the predetermined flow rate curve is pre-programmed in a control unit of the pumping system.

12. A method of reducing hot spots in a static electric induction system, the method including:

cooling a heat generating component of the static electric induction system by means of a flow of cooling fluid through a cooling duct along the heat generating component;

applying a varying flow rate over time of the flow of cooling fluid in the cooling duct along a predetermined flow rate curve, which is a function of time and is not required to be dependent on real-time measurements, by means of a pumping system of the static electric induction system;

wherein the flow rate curve oscillates between a predetermined maximum flow rate and a predetermined minimum flow rate.

13. The method according to claim 12, wherein a hot spot of the heat generating component moves depending on the varying flow rate.

14. The method according to claim 12, wherein a flow ratio of the cooling fluid passing through the cooling duct via a first flow path of a plurality flow paths of the cooling duct varies with the varying flow rate.

15. The method according to claim 12, wherein the flow rate is varying with a periodicity which is less than the time required for the heat generating component to reach thermal steady-state.

16. The method according to claim 15, wherein the flow rate is varying with a periodicity which is less than a thermal time constant of the heat generating component.

17. The method according to claim 12, wherein the cooling fluid is circulated in the static electric induction system via a cooling loop including a heat exchanger, wherein the flow rate of the cooling fluid through the heat exchanger is substantially constant.

18. The method according to claim 12, further including distributing the cooling fluid to the cooling duct via a pressure chamber.

19. The method according to claim 12, wherein the cooling duct includes a plurality of flow paths connected in parallel with each other.

* * * * *